United States Patent [19]

Levinson et al.

[11] 4,042,091

[45] Aug. 16, 1977

[54] RECORD MATERIAL FEED APPARATUS

[75] Inventors: Leo Levinson, Berkeley; Andrew Wong, Fremont, both of Calif.

[73] Assignee: Xerox Corporation, Stamford, Conn.

[21] Appl. No.: 670,464

[22] Filed: Mar. 25, 1976

[51] Int. Cl.[2] ..... B41J 15/04

[52] U.S. Cl. ..... 197/138 R; 197/127 R

[58] Field of Search ..... 197/127 R, 133 R, 133 P, 197/138 R, 138 A, 143, 144, 149

[56] References Cited

U.S. PATENT DOCUMENTS

| | | | |
|---|---|---|---|
| 1,462,697 | 7/1923 | Hart | 197/143 |
| 1,840,817 | 1/1932 | Lear | 197/138 A |
| 1,945,026 | 1/1934 | Crosman | 197/128 |
| 1,988,189 | 1/1935 | Dobson | 197/138 A |
| 2,047,233 | 7/1936 | Sherman | 197/133 P |
| 2,081,423 | 5/1937 | Crosman | 197/127 R |
| 2,355,668 | 8/1944 | Morse | 197/133 P |
| 2,713,932 | 7/1955 | Letterman | 197/138 A |
| 3,154,184 | 10/1964 | Gallant et al. | 197/149 |
| 3,444,977 | 5/1969 | Kinney et al. | 197/138 R |
| 3,625,333 | 12/1971 | Cortona et al. | 197/138 R |
| 3,753,483 | 8/1973 | Lundquist | 197/127 R |

*Primary Examiner*—Louis G. Mancene
*Assistant Examiner*—Paul J. Hirsch
*Attorney, Agent, or Firm*—M. J. Colitz; T. J. Anderson; B. P. Smith

[57] ABSTRACT

Record material feed apparatus for use with a printing machine of the type including a platen, means for rotating the platen about its axis, at least one roller, a lever capable of manual movement between first and second positions, and means coupled between the lever and the roller for maintaining the roller in engagement with the platen when the lever is in its first position and for maintaining the roller spaced a predetermined distance from the platen when the lever is in its second position. The feed apparatus comprises a drive assembly capable of engaging and, when enabled, feeding a marginally punched record material that is loaded thereon, a guide rack coupled to the drive assembly and capable of manual movement between a first position in which a record material may be loaded onto the drive assembly and a second position in which a record material fed by the drive assembly may be guided along the guide rack, and means coupled to the guide rack and capable of engaging the lever when the feed apparatus is mounted to the printing machine for automatically moving the lever from its first position to its second position when the guide rack is manually moved from its first position to its second position, and for automatically returning the lever to its first position when the rack is manually returned to its first position.

2 Claims, 6 Drawing Figures

RECORD MATERIAL FEED APPARATUS

BACKGROUND OF THE INVENTION

This invention relates to apparatus capable of feeding marginally punched record material and, more particularly, to such an apparatus for use in a printing machine of the type comprising a platen, means for rotating the platen about its axis, at least one roller, a lever capable of manual movement between first and second positions, and means coupled between the lever and roller for maintaining the roller in engagement with the platen when the lever is in its first position and for maintaining the roller spaced a predetermined distance from the platen when the lever is in its second position.

Printing machines incorporating the above-referenced elements have been known for decades, as evidenced by U.S. Pat. Nos. 1,270,292 and 3,753,483. The latter patent also discloses a conventional tractor feed apparatus for use with a typewriter including the above-referenced elements.

It is, of course, well known that when loading and feeding non-marginally punched record material, such as ordinary plain paper, through a printing machine by a conventional platen-pressure roller arrangement, it is generally necessary to maintain the roller or rollers in engagement with the platen to define a nip or nips for positive feeding. It is also well known that the rollers may be moved away from the platen in order to correctly align the record material when loaded, or to facilitate removal of the material.

When feeding marginally punched record material, such as computer forms paper, it is generally necessary to use a feeding apparatus different that the conventional platen-pressure roller arrangement. The two most common types of feeding apparatus for this type of record material are the pin-feed apparatus and the tractor feed apparatus. As indicated above, an exemplary tractor feed apparatus is disclosed in U.S. Pat. No. 3,753,483. An exemplary pin-feed apparatus is disclosed in my co-pending application Ser. No. 660,555 entitled PIN FEED APPARATUS and assigned to the assignee of the present invention. In both the pin-feed apparatus and the tractor feed apparatus, the pressure rollers must necessarily be disengaged from the platen during feeding. To this end, a lever and associated structure of the type generally described above is provided in the printing machine for enabling the rollers to be manually retracted and disengaged from the platen. However, during loading of the marginally punched record material onto the feeding apparatus (pin or tractor), it has been found beneficial to position the lever so that the rollers are again engaged with the platen. In this manner, the platen knobs may be manually rotated to positively advance the record material through the nip between the platen and rollers to the location of the pin or tractor assembly, whichever the case may be.

Very recently, it has become the practice to utilize one or more guide racks with a feed apparatus for marginally punched record material. This is primarily due to the propensity of the material to bend at its periodic line perforations, the material capable of being torn along such perforations in order to separate the material into individual sheets. When bending, the outfeed of material may tend to get caught into the infeed. This is especially true when the feeding apparatus has a reverse feed capability as is the case with the pin feed apparatus disclosed in my above-mentioned co-pending application Ser. No. 660,555 . A guide rack is used to positively segregate the infeed and outfeed record material.

In order to facilitate loading of the marginally punched record material into the printing machine and onto the feed apparatus, the guide racks used to date have been made pivotal between a first or loading position in which the record material may be loaded, and a second or feeding position in which record material fed by the feed apparatus is guided along the rack away from the machine.

The normal manner of readying the printing machine and feed apparatus equipped with a guide rack of the above type is to pivot the rack to its first position and move the lever to a position engaging the rollers against the platen. Then, the marginally punched record material is loaded into the machine and through the nip between the platen and rollers. The platen is then manually rotated until the record material is at a location to be engaged by the feed apparatus. The record material is then so engaged, the lever moved to a position disengaging the rollers from the platen, and the rack pivoted to its second position.

It would be desirable to provide a feed apparatus for marginally punched record material of the type equipped with a guide rack wherein the number of required manual operations is reduced. More specifically, it would be desirable if the manual movement of the guide rack could cause the desired corresponding movement of the pressure roller or rollers.

SUMMARY OF THE INVENTION

A record material feed apparatus is provided for use in a printing machine of the type including a platen, means for rotating the platen about its axis, at least one roller, a lever capable of manual movement between first and second positions, and means coupled between the lever and the at least one roller for maintaining the roller in engagement with the platen when the lever is in its first position and for maintaining the roller spaced a predetermined distance from the platen when the lever is in its second position.

In accordance with the present invention, the feed apparatus comprises a drive assembly capable of engaging and, when enabled, feeding a marginally punched record material that is loaded thereon; a guide rack coupled to the drive assembly and capable of manual movement between a first position in which a marginally punched record material may be loaded onto the drive assembly and a second position in which a marginally punched record material fed by the drive assembly may be guided along the guide rack; and means coupled to the guide rack and capable of engaging the lever when the feed apparatus is mounted to the printing machine for automatically moving the lever from its first position to its second position when the guide rack is manually moved from its first position to its second position, and for automatically returning the lever to its first position when the guide rack is manually returned to its first position.

These and other aspects and advantages of the present invention will be more completely described below with reference to the accompanying drawings.

DESCRIPTION OF THE PREFERRED EMBODIMENT

Figure 1:
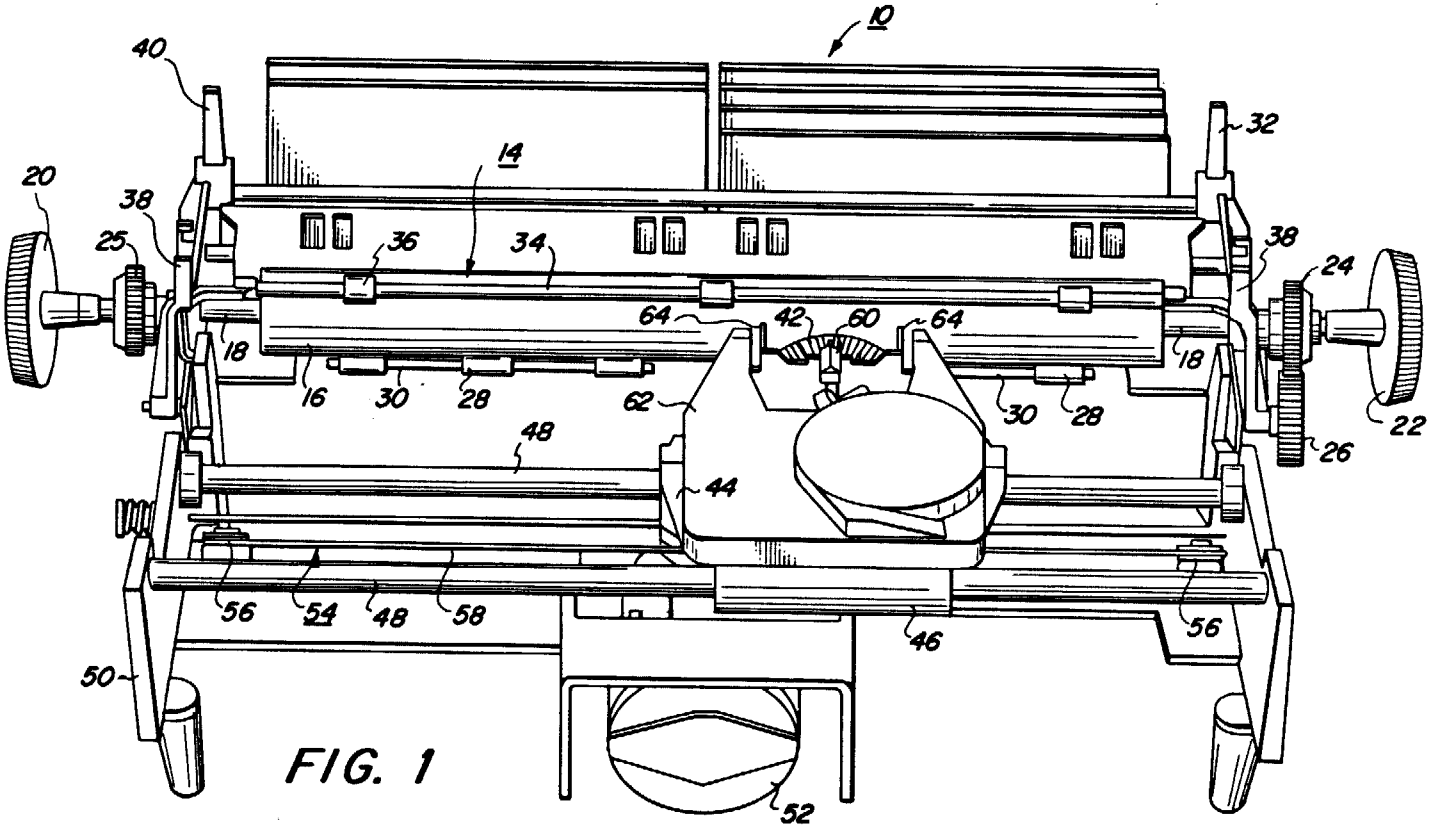
FIG. 1 is a front perspective view of a printing machine with which a record material feed apparatus of the present invention may be used.
Figure 2:
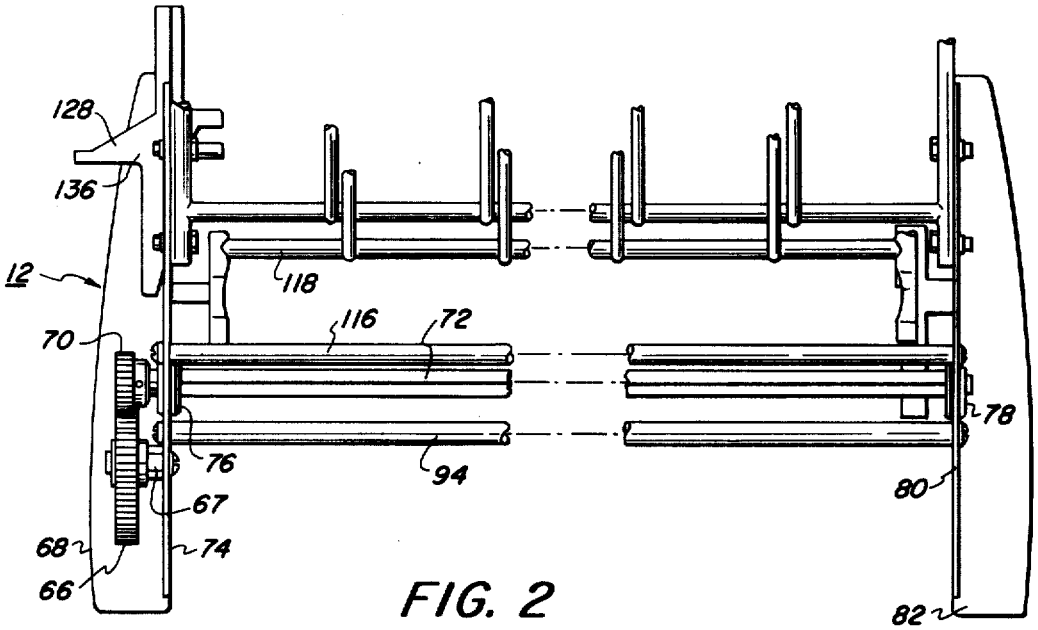
FIG. 2 is a fragmentary top plan view of a record material feed apparatus of the present invention with certain components deleted or shown in phantom for clarity of others.
Figure 3:
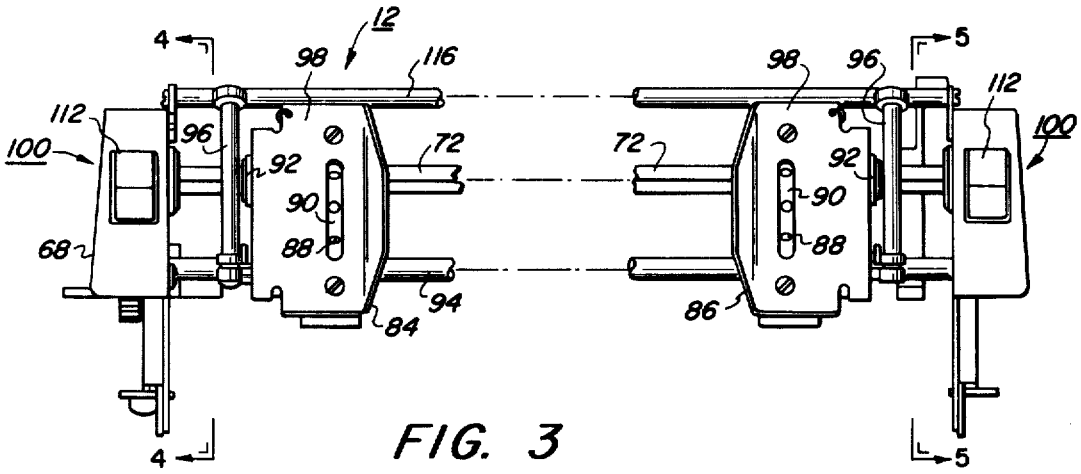
FIG. 3 is a fragmentary side elevation view of the feed apparatus of FIG. 2.

Referring to FIG. 1, a serial printer 10 is shown with which a record material feed apparatus 12 (FIGS. 2–6) of the present invention may be employed. By way of example, the record material feed apparatus is shown as being of the tractor feed type, although, as will become clear below, it could alternatively be of the pin feed type and still utilize the unique features of the present invention to be described in more detail below.

Now then, with the feed apparatus 12 being of the tractor feed type, the printer 10 preferably incudes a conventional platen feed assembly 14 which comprises a platen 16 mounted to a rotatable shaft 18 for rotation therewith. Mounted at each end of the shaft 18 a pair of knobs 20 and 22 for enabling the manual rotation of the shaft 18 and platen 16. As is conventional, the knob 20 is fixed relative to the shaft and the knob 22 is movable axially of the shaft between first and second positions. When in a first position, a gear-drive assembly 24 mounted about the shaft 18 adjacent the knob 22 is engaged with the shaft so that a motor-gear arrangement 26 (only partly shown) coupled to the gear-drive assembly 24 controls the automatic rotation of the shaft 18. When in a second position, the knob 22 disengages the gear-drive assembly 24 from the shaft so that manual rotation of the knobs 20 and 22 will cause a corresponding rotation of the shaft 18 and platen 16.

Figure 5:
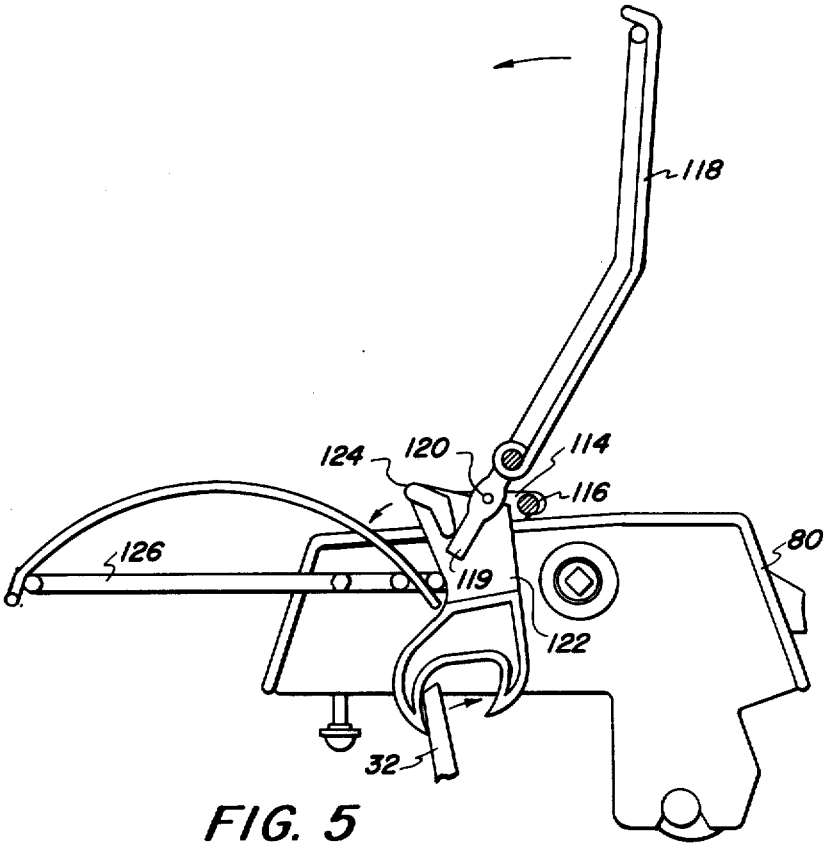
FIG. 5 is a sectional view of the feed apparatus of FIGS. 2–4 taken along lines 5—5 of FIG. 3 and showing a guide rack of the apparatus in a first position.
Figure 6:
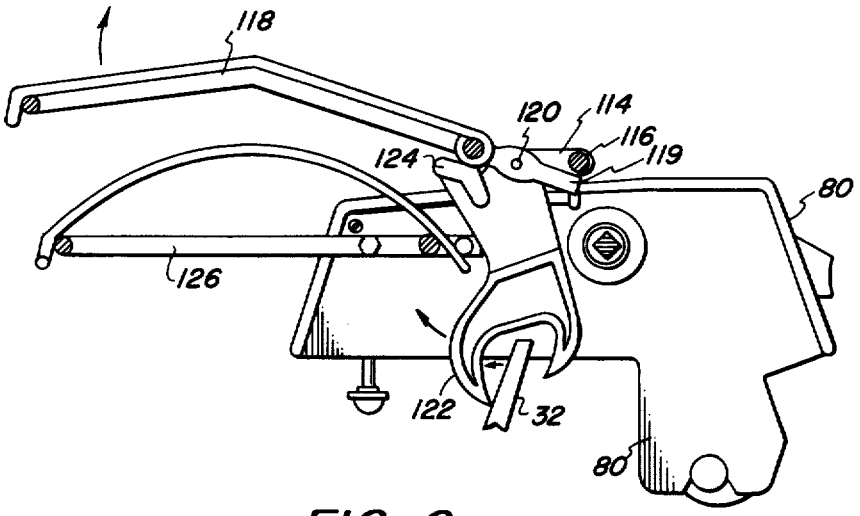
FIG. 6 is the view of FIG. 5 showing the guide rack in a second position.

The platen assembly 14 also comprises a plurality of pressure rollers 28 connected to one or more lower bail bars 30. By way of example, four bail bars 30 are employed (only the front two visible in FIG. 1), each bail bar having three rollers 28 rotatably mounted thereon. As is conventional in serial printers and typewriters, a spring-biased lever 32 is included in the printer 10 for manual movement between a first or rearward position (FIG. 5) and a second or forward position (FIG. 6). Conventional linkage means (not shown) is coupled between the lever 32 and the bail bars 30 and cooperates with conventional biasing springs (not shown) for maintaining the rollers 28 in pressure engagement with the platen when the lever is at its first position and for retracting and holding the rollers 28 a predetermined distance from the platen when the lever is moved to its second position.

The platen assembly 14 further includes an upper bail bar 34 having a plurality, e.g. three, follower rollers 36 rotatably mounted thereon. These rollers, when engaged with the platen 16, serve to hold the record material on the platen so that it is directed from the printer 10 in a generally rearward direction, as is conventional. Conventional spring-biased levers 38 are connected to the printer 10 and to the bail bars 34 for maintaining the rollers 36 in pressure engagement with the platen 16 when the levers 38 are in a first or rearward position, and for removing and holding the bail bar 34 and thus rollers 36 a predetermined distance forwardly of the platen 16 when the levers 38 are moved to a second or forward position.

The platen assembly 14 also preferably includes a lever 40 connected to the printer 10 and capable of being manually positioned at a number of detent positions corresponding to desired distances of the platen 16 from a print member 42 mounted adjacent the platen and to be described in more detail below. Appropriate and conventional linkage and mounting means (not shown) coupled between the lever 40 and the platen 16 achieves the desired shifting of the platen in response to movement of the lever 40.

The platen assembly additionally includes a gear assembly 25 fixed to the shaft 18 preferably adjacent the knob 20. The gear assembly 25 is thus rotatable along with the shaft 18 and, as will be described in more detail below, couples motor-drive power as applied to the shaft 18 through the motor-gear arrangement 26 and the gear-drive assembly 24, to the tractor feed apparatus as is mounted to the printer 10 in a manner to be described below.

The platen assembly 14 as thus described is entirely conventional and further details thereof may be obtained, by way of example, through a review of the HyType II serial printer manufactured by Diablo Systems, Inc. of Hayward, Cal.

Still referring to FIG. 1, the printer 10 also includes a carriage assembly 44 mounted by a pair of bearing members (only one shown) to a respective pair of rods 48 which are themselves mounted at each end to a main support frame 50 of the printer 10. Details of an exemplary carriage assembly are disclosed in co-pending U.S. application Ser. No. 664,789 filed in the names of Mario G. Plaza and Richard D. Trezise for PRINT MEMBER CARRIAGE ASSEMBLY and assigned to the assignee of the present invention.

A drive motor 52 is coupled by a suitable cable-pulley arrangement 54 to the carriage assembly 44. As is conventional, the cable-pulley arrangement includes a first pulley (not shown) connected to the shaft of the drive motor 52, a plurality of (e.g., two or four ) second pulleys 56 coupled to opposing sides of the machine frame 50 and a third pulley (not shown) connected to the carriage assembly 44. At least one cable 58 is wrapped around the pulleys for imparting linear motion to the carriage assembly 44 along the rails 48 in response to rotation of the motor-drive shaft. For more details of the specific cable-pulley arrangement shown in the drawings, reference may be had to the aforementioned HyType II serial printer. For an alternative approach, reference may be had to U.S. Pat. No. 3,872,960.

The carriage assembly 44 generally includes and is adapted to transport the print member 42, which may be a "daisy wheel" type of print wheel and which is mounted for rotation about its axis, a drive motor (not shown) for controlling the direction and speed of rotation of the print wheel 42, a hammer assembly 60 for impacting an aligned character element on the print wheel against the adjacent support platen 16, a ribbon carriage 62 for supplying inked ribbon 16 (not shown) between the hammer assembly 60 and the platen, and a ribbon cartridge motor (not shown) for transporting ribbon in front of the hammer assembly along a pair of guides 64 during operation of the printer.

The specific nature of the hammer assembly 60 and ribbon cartridge 62 form no part of the present invention and thus will not be described in detail herein. However, details of an exemplary hammer assembly are disclosed in co-pending U.S. Application Ser. No. 664,797 filed in the names of Mario G. Plaza and Michael C. Weisberg for HAMMER ASSEMBLY and assigned to the assignee of the present invention, and details of an exemplary ribbon cartridge are disclosed in co-pending U.S. Application Ser. No. 633,530 filed Nov. 19, 1975 in the names of Mario G. Plaza and Richard D. Trezise for DUAL LEVEL RIBBON CARTRIDGE and assignee to the assignee of the present invention.

The tractor feed apparatus 12 will now be described with reference to FIGS. 2-6. As shown, the apparatus 12 includes a drive assembly comprised of a first gear 66 rotatably mounted about a shaft 67 fixed to the side wall 74 of a housing 68 in which the gear is disposed. The gear 66 is adapted to engage the gear 25 of the printer 10 (FIG. 1) when the apparatus 12 is mounted to the printer in a manner to be described below. The drive assembly further comprises a second gear 70 mounted on the end of a shaft 72 for rotation therewith. The gear 70 also is located within the housing 68 and in engagement with the first gear 66. The shaft 72 is supported at one end through an opening in the side wall 74 of the housing 68 by a suitable bearing member 76. Additionally, the shaft 72 is supported at its other end by a bearing member 78 through an opening in the side wall 80 of another housing 82 substantially identical to the housing 68.

The drive assembly of the tractor feed apparatus 12 further comprises a pair of conventional tractor sprocket drive assemblies 84 and 86. The assemblies 84 and 86 each include a plurality of teeth 88 supported or formed on respective drive belts 90. As is conventional, each belt 90 is supported about a pair of hubs 92 (only one shown). One of the hubs 92 is a drive hub mounted about the shaft 72 and the other hub is a guide hub mounted about a fixed shaft 94 connected between the opposing side walls 74 and 80 of the housings 68 and 82. Each sprocket assembly 84 and 86 further comprises a conventional clamp assembly 96 for enabling the sprocket assemblies to be selectively adjusted in linear position along the shafts 72 and 94 dependent upon the width of the record material used.

Each sprocket drive assembly 84 and 86 has a spring loaded front door 98 which is pivotal from a closed position as shown to an open position (not shown). In the opened position, a marginally punched record material can be loaded onto the track feed apparatus 12 by engaging the marginally punched holes thereof with the teeth 88.

Figure 4:
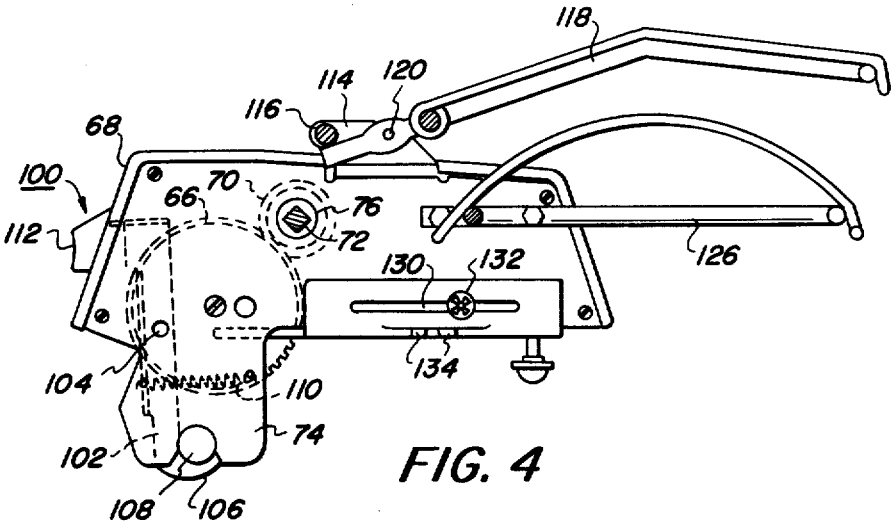
FIG. 4 is a sectional view of the feed apparatus of FIGS. 2 and 3 taken along lines 4—4 of FIG. 3.

As best shown in FIG. 4, each housing 68 and 82 includes a conventional button-operated clamp assembly 100 which comprises a pivot member 102 mounted within the housing for pivotal movement about a pivot pin 104. Each member has a hook 106 at its lower end which forms an opening 108 with a recess formed in the side wall (74 and 80) of the housing (68 and 82) when the pivot member is at a first position as shown in FIG. 4. The pivot members 102 are normally biased in their positions by respective spring members 110 mounted in the housing and connected thereto. A button 112 in the front side of each housing 68 and 82 can be depressed to pivot the respective pivot member 102 in order to move the hook clear of the opening 108. When so moved, the tractor feed apparatus 12 can be mounted to the printer 10 by engaging the shaft 18 in the openings 108 of each housing 68 and 82 and then releasing the buttons 112 to restore the hooks 106 to the position shown in FIG. 4 thereby locking the housings 68 and 82 about a bearing (not shown) mounted on the shaft 18. Of course, such locking does not inhibit the shaft 18 from rotating within the openings 108 relative to the housings 68 and 82.

The tractor feed apparatus 12 is preferably mounted to the printer 10 by locking the hook 106 of housing 68 around the shaft 18 at a location between the gear 25 and the frame 50, and the hook 106 of housing 82 around the shaft at a location between the gear-drive arrangement 24 and the frame 50. When so positioned, the gear 66 will be positively engaged with the gear 25.

Forming part of each side wall 74 and 80 is an upwardly extending bracket 114. A third shaft 116 is affixed to each bracket for lending rigidity to the apparatus 12. Additionally, a guide rack 118 is pivotably mounted to the brackets 114 about respective pivot pins 120 attached to each bracket. The rack 118 is capable of being pivoted from a first position shown in FIG. 5 to a second position shown in FIGS. 4 and 6. When in the first position, record material may be loaded into the printer 10 and then onto the tractor drive assembly in the manner described above. When in the second position, record material fed by the tractor drive assembly may be guided along the rack 118 away from the printer 10.

Referring to FIG. 6, an interlock member 122 is pivotably mounted to the bracket 114 of the housing 82. The member 122 is desirably "claw-shaped" at the bottom and has a flange portion 124 extending therefrom. The guide rack 118 normally rests in its second position with the end 119 of the closest adjacent support of the rack contacting the shaft 116 which acts as a stop in this position of the rack. Additionally, the interlock member 122 is engaged with the lever 32 which, as shown, is at its second position. Then, by pivoting the rack upwardly and forwardly in the direction shown by the arrow in FIG. 6, the end 119 of the rack support will eventually contact the flange portion 124 of the interlock member 122 causing the latter to pivot about the pin 120. The rack 118 and interlock member 122 may continue to be pivoted about the pin 120 until the interlock member abuts against another guide rack 126, as shown in FIG. 5. In the process of so pivoting, the interlock member will engage the front side of the lever 32 moving it rearwardly until the internal spring bias is rendered operative to force the lever 32 all the way forwardly into its first position, i.e. with the rollers 28 engaged with the platen. This first or forward position of the lever 32 is shown in FIG. 5 where it will be noted that the interlock member 122 rests against the rear side of the lever 32.

In the position shown in FIG. 5, record material may be conveniently loaded into the printer 10 and onto the tractor drive assembly. Loading into the printer and about the platen 16 is facilitated since the pressure rollers 28 are engaged with the platen. When the record material has been loaded onto the drive assembly, the rack is pivoted rearwardly and downwardly into its second position (FIG. 6), overcoming the biasing force on the lever 32 and moving it into its second position (also shown in FIG. 6). With the rollers 28 thereby disengaged from the platen 16, the tractor feed apparatus 12 may be operated to feed the record material through the printer 10, where it will be guided therefrom along the rack 118.

It should be noted that the second rack 126 is fixed to the side walls 74 and 80 and functions to enable record material being fed by the tractor feed apparatus 12 through the printer to be guided therealong toward and into the printer. Thus, the rack 126 may be characterized as an "infeed" rack and the rack 118 as an "outfeed" rack.

Referring again to FIG. 4, a slider member 128 is attached to the side wall 74 of the housing 68. More specifically, the slider member 128 has an elongate opening 130 which is adapted to accommodate in relatively slidable relation a bolt 132 affixed to the side wall 74. The member 128 has a pair of teeth 134 extending downwardly therefrom for engaging the lever 40 (FIG. 1) of the printer 10 on either side thereof. A grip 136 extends outwardly of the member 128 in order to enable an operator to manually position the member 128 relative to the bolt 132, thereby enabling the lever 40 to be easily controlled notwithstanding its obstruction by the tractor feed apparatus 12 when mounted to the printer 10.

Although the present invention has been described with respect to a presently preferred embodiment, it will be appreciated by those skilled in the art that various modifications, substitutions, etc. may be made without departing from the spirit and scope of the invention as defined by the following claims. For example, and as alluded to above, the record material feed apparatus could be a pin feed apparatus having a movable guide rack, such as disclosed in my above-referenced copending application Ser. No. 660,555. An appropriate interlock member equilavent in function to member 122 would then be used to automatically control movement of the lever 32 in response to manual movement of the guide rack.

What is claimed is:

1. Record material feed apparatus for use with a printing machine of the type including a platen, means for rotating the platen about its axis, at least one roller, a lever capable of manual movement between first and second positions, and means coupled between the lever and said at least one roller for maintaining the roller in engagement with the platen when the lever is in its first position and for maintaining the roller spaced a predetermined distance from the platen when the lever is in its second position, said feed apparatus comprising:

a drive assembly capable of engaging and, when enabled, feeding a marginally punched record material that is loaded thereon;

a guide rack pivotably mounted to said drive assembly about a pivot pin and capable of manual pivotal movement between a first position in which a marginally punched record material may be loaded onto said drive assembly and a second position in which a marginally punched record material fed by said drive assembly may be guided along said guide rack; and an interlock member pivotably mounted to said drive assembly about said pivot pin and capable of engaging said lever and being engaged by said guide rack when said feed apparatus is mounted to said printing machine for automatically moving said lever from its first position to its second position when said guide rack is manually pivoted from its first position to its second position, and for automatically returning said lever to its first position when said rack is manually returned to its first position.

2. The apparatus of claim 1, wherein said drive assembly includes at least one sprocket drive assembly and means for mounting said guide rack to said sprocket drive assembly, said apparatus being a tractor feed apparatus.

* * * * *